US006222108B1

(12) United States Patent
Liao

(10) Patent No.: US 6,222,108 B1
(45) Date of Patent: Apr. 24, 2001

(54) PERCUSSION AMPLITUDE ADJUSTABLE PEDAL DRUM-BEATING DEVICE

(75) Inventor: Tsun-Chi Liao, Taichung (TW)

(73) Assignee: Hwa Shin Musical Instrument Co., Ltd., Taichung (TW)

( * ) Notice: Subject to any disclaimer, the term of this patent is extended or adjusted under 35 U.S.C. 154(b) by 0 days.

(21) Appl. No.: 09/553,056

(22) Filed: Apr. 20, 2000

(51) Int. Cl.[7] ..... G10D 13/02
(52) U.S. Cl. ..... 84/422.1
(58) Field of Search ..... 84/422.1–422.4

(56) References Cited

U.S. PATENT DOCUMENTS 5,343,792 * 9/1994 Liao ..... 84/422.1
5,398,584 * 3/1995 Liao ..... 84/422.1
5,421,234 * 6/1995 Liao ..... 84/422.1
5,714,701 * 2/1998 Hsieh .

* cited by examiner

*Primary Examiner*—Jeffrey Donels
(74) *Attorney, Agent, or Firm*—Bacon & Thomas, PLLC

(57) ABSTRACT

A percussion amplitude adjustable pedal drum-beating device is provided with a flywheel pivotally disposed on a rotation shaft, wherein the flywheel comprises a main body and a clutch piece; the tail end of the flywheel is a pivotal joint while the other end is kept open. A fixing stud is used to lock the main body and the clutch piece together, and a positioning ferrule is disposed in-between the main body and the clutch piece. A plurality of row teeth are formed on the positioning ferrule, which is also provided with an axial open channel at one end.

5 Claims, 6 Drawing Sheets

PERCUSSION AMPLITUDE ADJUSTABLE PEDAL DRUM-BEATING DEVICE

BACKGROUND OF THE INVENTION

This invention relates generally to a pedal drum-beating device, more particularly, it relates to a percussion amplitude adjustable pedal drum-beating device, in which a flywheel can be certainly and rapidly locked on a rotation shaft.

A percussion drum, among other musical instruments, is used to provide more distinct beats in performance of a concert. A conventional pedal drum-beater shown in FIG. 1 is provided with a rotation shaft, whereon a drum-beater and an interactive flywheel device are arranged; and a drive chain wound on the flywheel device is coupled to a free end of a pedal with its one end so that a drum is stricken by tramping the pedal drum-beater via the drive chain and the flywheel device. The flywheel device composed of a flywheel and two clutch pieces is locked on the rotation shaft by two fixing studs (shown in FIG. 2), and a positioning ferrule is inserted between those two clutch pieces and the rotation shaft. However, a percussion amplitude adjustable structure formed as abovesaid may cause occasional race rotation attributable to the loose clamp of the clutch pieces onto the positioning ferrule because of its slippery outer face.

In view of abovesaid defect, this invention is proposed with an improved design for clamping a flywheel firmly to a rotation shaft by pivotally jointing tail end of a main body and a clutch piece together and locking the other end with a single fixing stud, and forming a row teeth on a positioning ferrule to create beats positively and reliably.

SUMMARY OF THE INVENTION

The primary object of this invention is to clamp a flywheel firmly on a rotation shaft.

Another object of this invention is to clamp a clutch piece firmly on a positioning ferrule for prevention of any slip phenomenon between the positioning ferrule and the rotation shaft.

In order to realize the abovesaid objects, a flywheel comprising a main body and a clutch piece is pivotally disposed on a rotation shaft, wherein the tail end of the main body and the clutch piece are pivotally jointed while their other ends are kept open. A fixing stud is used to lock the main body and the clutch piece to form a unified assembly, and a positioning ferrule is disposed in-between the main body and the clutch piece. Moreover, a row of teeth is formed on the positioning ferrule, which is provided with an axial open channel at its one end. By proper assembly of foregoing components of this invention, a lever structure is formed to realize a rapid and dependable attachment on the rotation shaft and without slipping.

A detailed description of this invention together with further advantages or features thereof, at least an example of a preferred embodiment thereof will be described below with reference to the annexed drawings.

BRIEF DESCRIPTION OF THE DRAWINGS

The related drawings in connection with the detailed description of this invention to be made later are described briefly as follows in which.

DETAILED DESCRIPTION OF THE PREFERRED EMBODIMENT

Figure 1:
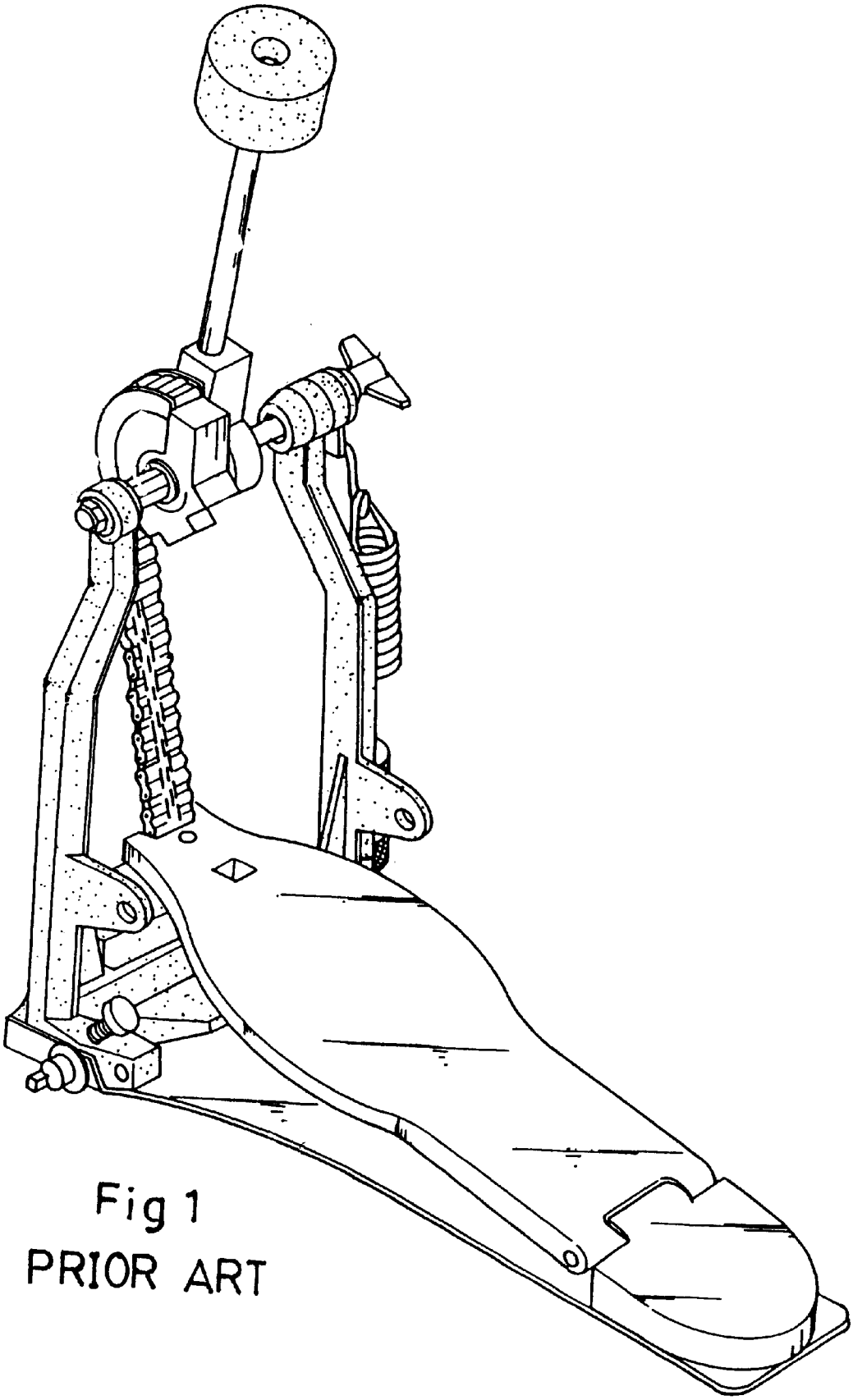
Fig 1 PRIOR ART
FIG. 1 is a perspective view of a conventional pedal device.
Figure 2:
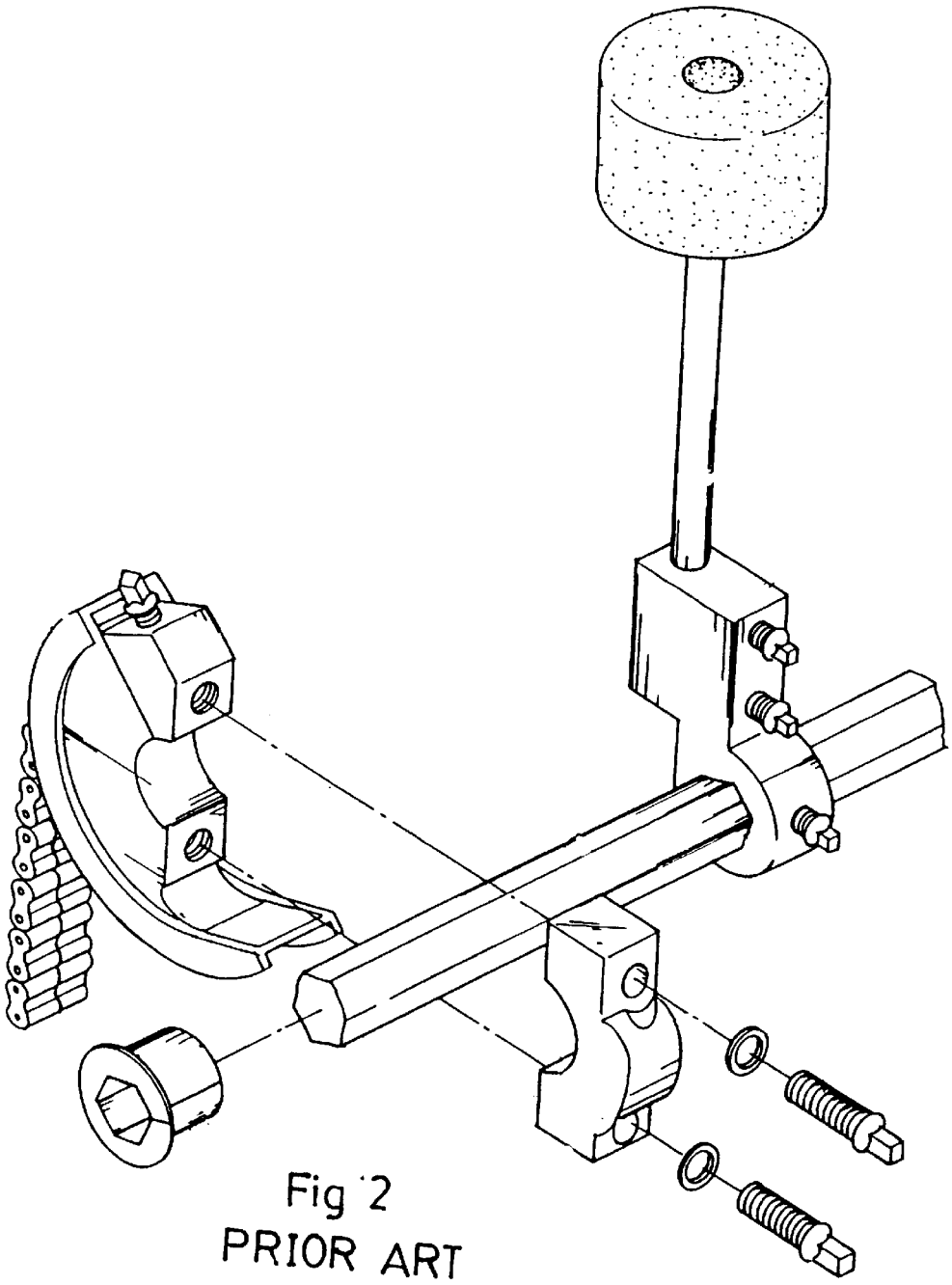
Fig 2 PRIOR ART
FIG. 2 is an exploded perspective exploded view of a conventional percussion amplitude adjustment structure.
Figure 3:
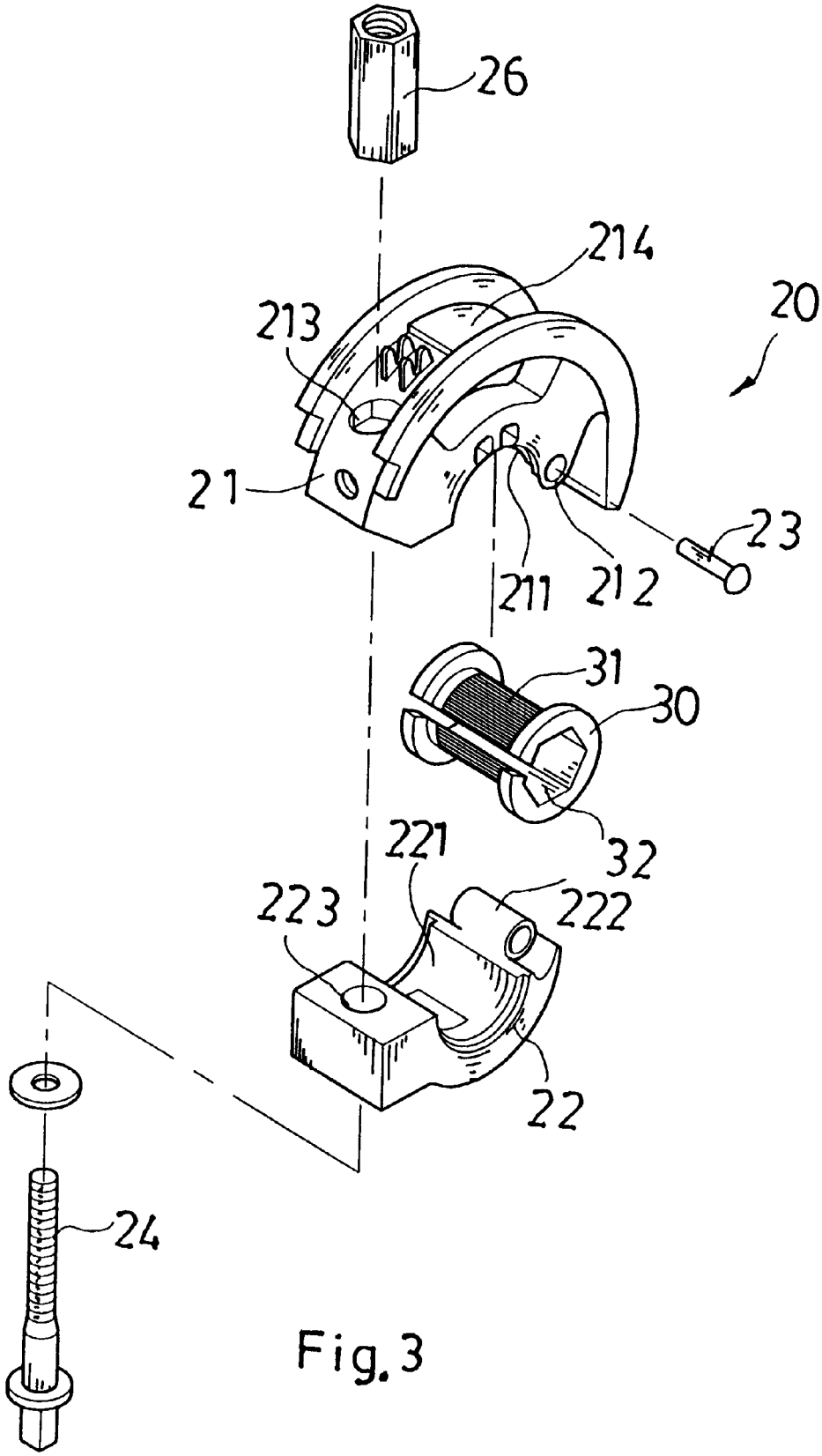
FIG. 3 is an exploded perspective exploded view of this invention.
Figure 4:
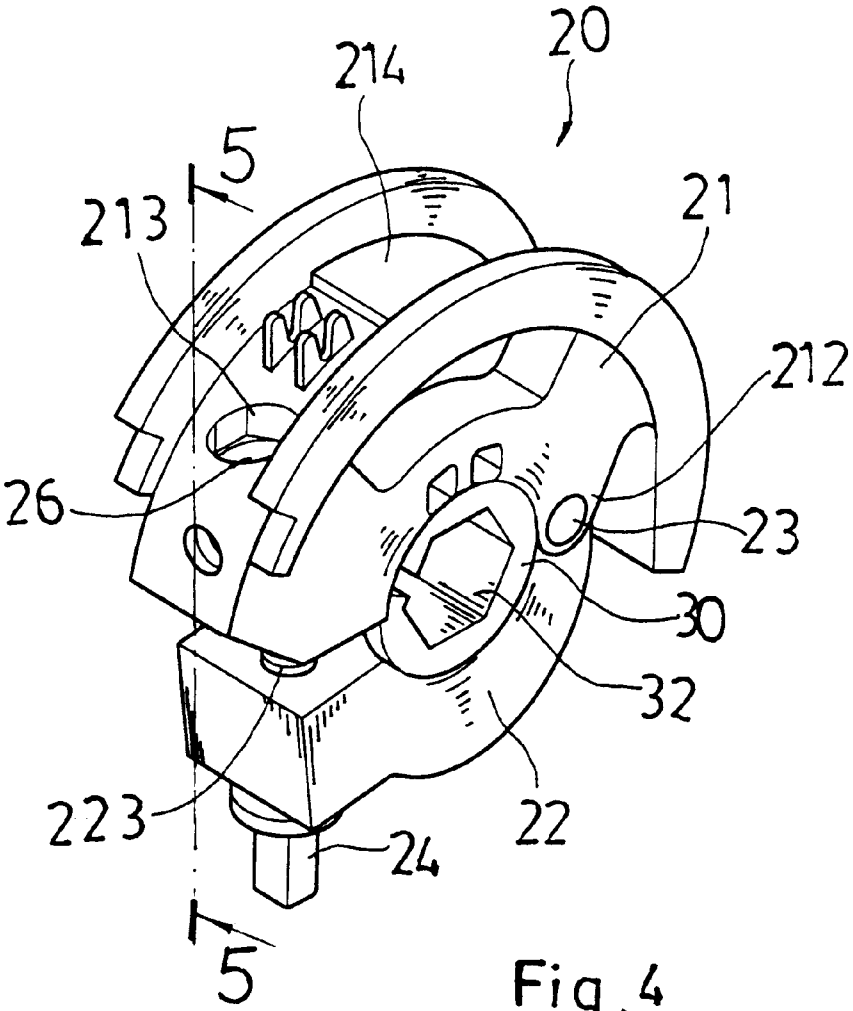
FIG. 4 is an assembled perspective assembled view of this invention.
Figure 5:
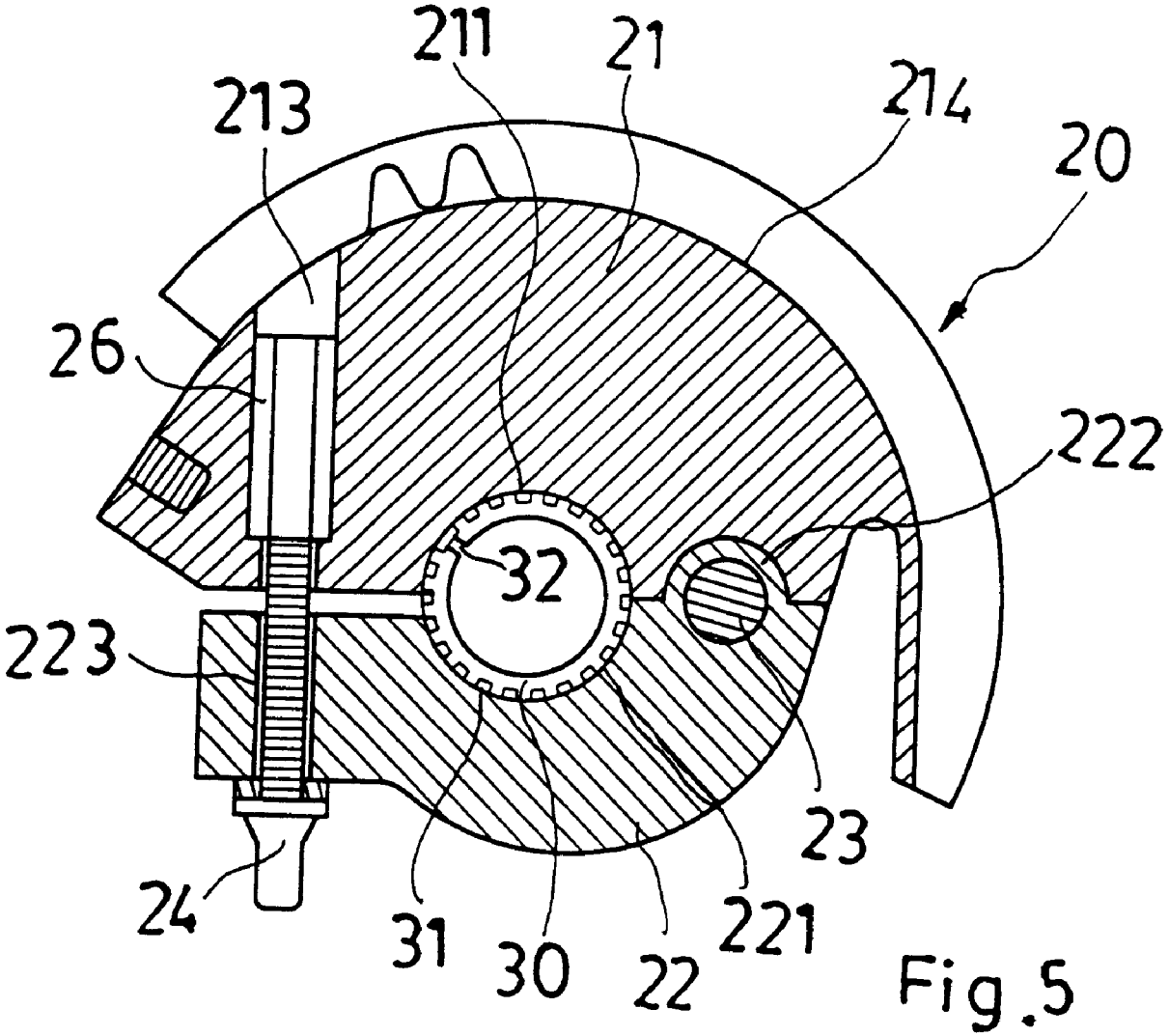
FIG. 5 is a cutaway sectional view taken along line 5—5 in FIG. 4.
Figure 6:
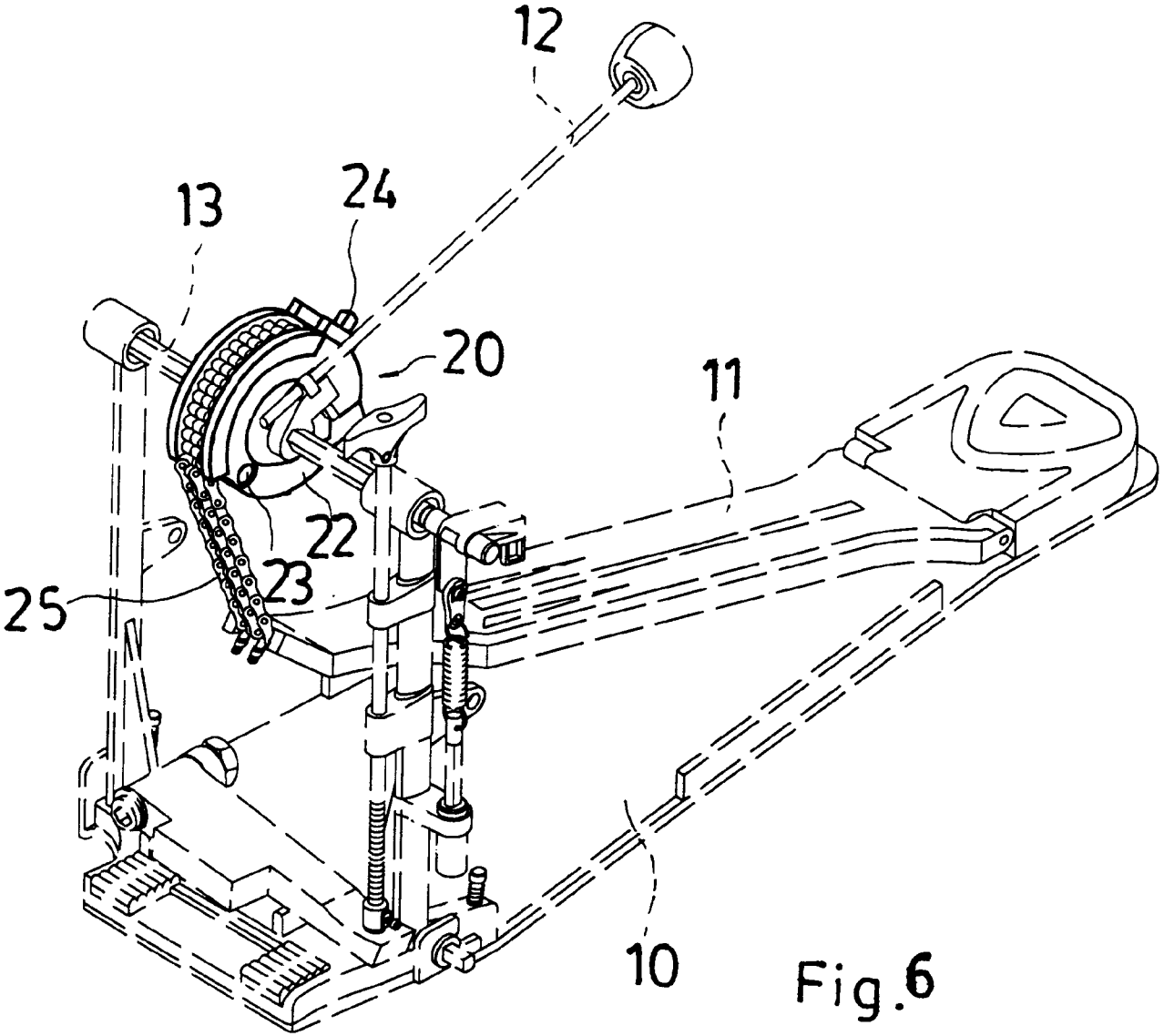
FIG. 6 is a schematic application view of this invention.

As shown in FIG. 3 through FIG. 6, this invention is assembled on a rotation shaft 13 of a pedal base 10 including a foot pedal 11 and a drum-beater 12, wherein a flywheel device 20 is pivotally disposed on the rotation shaft 13.

The flywheel device 20 is composed of a main body 21 and a clutch piece 22, wherein a semi-circular receptacle 211, 221 is formed oppositely in the main body 21 and the clutch piece 22 respectively; a split positioning ferrule 30 is arranged in the semi-circular receptacles 211, 221; pair of corresponding pin sleeves 212, 222 are formed at a tail end of the main body 21 and the clutch piece 22 respectively; and, the sleeves 212, 222 are pivotally combined by inserting a positioning pin 23 therethrough to form a hinge structure. The front end of the main body 21 and the clutch piece 22 are open, and wherein a screw hole 213 is formed in the front end of the main body 21 for accommodating a screw nut 26, and a tapped hole 223 is formed in the front end of the clutch piece 22 at a position corresponding to the screw hole 213 for receiving a fixing stud 24 to lock the main body 21 and the clutch piece 22 into a unified assembly. Besides, a guide channel 214 for maintaining a drive chain 25 in place encircles the circumference of the main body 21, and one end of the drive chain 25 is coupled with the front end of the foot pedal 11.

Moreover, a plurality of row teeth 31 is aligned annularly on the circumference of the split positioning ferrule 30, which is further provided axially with an open channel 32 for receiving and clamping the rotation shaft 13 by the body 21 and the clutch piece 22 30 and the rotation shaft 13 firmly.

In this invention constructed by abovesaid components, the sleeves 212, 222 and the positioning pin 23 are used to pivotally combine the main body 21 with the clutch piece 22. After the positioning ferrule 30 is disposed in the semi-circular receptacles 211, 221, the fixing stud 24 is inserted through the screw hole 213 and fixed in the screw nut 26 to form a lever structure for stably clamping on the positioning ferrule 30. In addition, the open channel 32 and the row teeth 31 facilitate to the fixing stud 24 for clamping this invention on the rotation shaft 13. Thus, the pedal 11 is tramped to drive the drum-beater 12 to strike the drum through the drive chain 25, the flywheel device 20, and rotation shaft 13.

According to abovesaid, the merits of this invention may be summarized as the following:

1. By using the sleeves 212, 222 and the positioning pin 23 to pivotally join the tail end of the main body 21 with that of the clutch piece 22 and using the fixing stud 24 to lock another open end of the main body 21 and that of the clutch piece 22 to form a lever structure, this invention can clench and lock the split positioning ferrule 30 firmly around shaft 13 with ease.

2. The open channel 32 is helpful in engaging the positioning ferrule 30 with the rotation shaft 13 when locking.

3. The teeth 31 are helpful in engaging the main body 21 and the clutch piece 22 onto the positioning ferrule 30 for prevention of any possible slip phenomenon.

4. When adjustment of percussion amplitude is desired, all a user has to do is release the fixing stud 24, then swivel the fixing stud 24 to lock again after adjustment. This simple procedure is far more convenient than a conventional device, without need imbalance of those two fixing studs, the slippery outer face of the positioning ferrule, etc that may cause slip page between the flywheel and the rotation shaft.

Although, this invention has been described in terms of a preferred embodiment, it is apparent that numerous variations and modifications may be made without departing from the true spirit and scope thereof, as set forth in the following claims.

What is claimed is:

1. A percussion amplitude adjustable pedal drum-beating device, comprising:

a rotation shaft; and a flywheel pivotally disposed on said rotation shaft, wherein said flywheel further comprises a main body and a clutch piece; a semi-circular receptacle is formed in each of said main body and said clutch piece, said main body and said clutch piece are locked together with a fixing stud; a split positioning ferrule is inserted in said two semi-circular receptacles for pivotally disposing said flywheel on said rotation shaft so that said flywheel will rotate after said rotation shaft; and a guide channel for maintaining a drive chain in place is formed in the circumference of said main body;

a pivotal joint formed at a tail end of said main body and said clutch piece; an open front end opposite to said pivotal joint end; a screw hole and a tapped hole formed in the front end of said main body and said clutch piece; a fixing stud inserted in said screw hole and said tapped hole to lock said main body and said clutch piece together.

2. The percussion amplitude adjustable pedal drum-beating device according to claim 1, wherein said pivotal joint is provided with a jutting ear disposed at said main body and said clutch piece respectively, and those two jutting ears are pivotally fixed with a positioning pin.

3. The percussion amplitude adjustable pedal drum-beating device according to claim 1, wherein a plurality of row teeth aligned annularly are formed on a circumference of said positioning ferrule to enable said main body and said clutch piece to clench said positioning ferrule.

4. The percussion amplitude adjustable pedal drum-beating device according to claim 1, wherein an axial open channel is formed inside said positioning ferrule to facilitate said main body and said clutch piece to clench said positioning ferrule and to clench and position said rotation shaft accordingly.

5. The percussion amplitude adjustable pedal drum-beating device according to claim 3, wherein an axial open channel is formed inside said positioning ferrule to facilitate said main body and said clutch piece to clench said positioning ferrule and to clench and position said rotation shaft accordingly.

* * * * *